United States Patent [19]

Bell

[11] 4,337,389

[45] Jun. 29, 1982

[54] GLOW PLUG CONTROL DEVICE FOR DIESEL ENGINES

[75] Inventor: Lon E. Bell, Altadena, Calif.

[73] Assignee: Technar, Inc., Arcadia, Calif.

[21] Appl. No.: 153,723

[22] Filed: May 27, 1980

Related U.S. Application Data

[63] Continuation of Ser. No. 887,035, Mar. 16, 1978, abandoned.

[51] Int. Cl.[3] ..... H05B 1/02; F02N 17/00

[52] U.S. Cl. ..... 219/511; 219/486; 219/493; 219/512; 123/179 H

[58] Field of Search ..... 219/492, 510, 494, 509, 219/511, 512, 518, 486, 205; 123/179 B, 179 H, 145 A

[56] References Cited

U.S. PATENT DOCUMENTS

| | | | |
|---|---|---|---|
| 2,970,201 | 1/1961 | Woodward | 219/511 X |
| 3,675,033 | 7/1972 | Richard et al. | 123/179 H |
| 3,691,393 | 9/1972 | Papachristov | 123/179 H |
| 4,088,109 | 5/1978 | Woodruff et al. | 123/179 H |
| 4,106,465 | 8/1978 | Bernhardt et al. | 123/179 H |
| 4,177,785 | 12/1979 | Sundeen | 123/179 B |

*Primary Examiner*—B. A. Reynolds
*Assistant Examiner*—M. Paschall
*Attorney, Agent, or Firm*—Christie, Parker & Hale

[57] ABSTRACT

A thermal device for controlling the temperature of glow plugs in a diesel engine in which current is applied to the glow plugs from the battery through a relay, the relay in turn being actuated by a thermally controlled switch controlled by a heater. The heater applies heat to the thermal-sensitive switch. The relay also controls current through the heater so that the heater cycles in unison with the glow plugs. The thermally-operated switch includes a bimetallic element which is heated by the heater. The bimetallic element is mounted in the engine block so as to be subject to the same ambient temperature conditions as the glow plugs. A thermal timer responsive to the same ambient temperature conditions includes a resistance heater element energized from the alternator. The thermal timer switch de-energizes the relay when heated to a predetermined temperature.

7 Claims, 9 Drawing Figures

GLOW PLUG CONTROL DEVICE FOR DIESEL ENGINES

CROSS REFERENCE TO RELATED APPLICATIONS

This is a continuation of application Ser. No. 887,035, filed Mar. 16, 1978, now abandoned.

FIELD OF THE INVENTION

This invention relates to a control device for energizing diesel engine glow plugs, and more specifically, is directed to a thermally controlled switching device for controlling the glow plugs.

BACKGROUND OF THE INVENTION

Diesel engines depend on the heating of a combustible mixture of fuel and air by compression. During starting of a diesel engine when the engine is cold, the compressive heating may not be sufficient to produce ignition. It has therefore been the practice to provide diesel engines with glow plugs to provide auxiliary heating during starting to produce ignition of the air-fuel mixture. The lower the ambient temperature conditions during the starting operation, the greater the amount of heat that must be supplied by the glow plugs to initiate combustion. Heretofore it has been the practice to preheat the glow plugs by connecting the glow plugs across the battery of the vehicle for sufficient time to allow the glow plugs to come up to the necessary operating temperature before engaging the starter. When the engine is started at relatively low ambient temperatures, such as may be experienced in the winter time in frigid areas, the heating time may be annoyingly long. While the heating time can be reduced by increasing the current to the glow plugs, this may result in damage to the glow plugs due to temperature overshoot. While automatic control circuits for diesel glow plugs have heretofore been proposed, such known circuits have merely controlled the timing of the turning on and turning off of the glow plugs, but have not controlled the temperature level of the glow plugs as a function of ambient temperature conditions.

SUMMARY OF THE INVENTION

The present invention provides an improved controller for the glow plugs of the diesel engine. The controller is a thermally-operated device which operates as a thermal analog of the glow plugs by making the thermal responsive device subject to the same ambient conditions as the glow plugs. By making the temperature profile of the glow plugs proportional to that of the thermal responsive control device, the power to the glow plugs can be controlled to match the desired heating characteristics. The thermal switch device is mounted in the block of the engine so as to be subject to the same ambient temperature conditions as the glow plugs. When the engine is cold and the ambient temperature low, the initial time during which the thermal switch remains closed is substantially longer than when the engine is hotter and the ambient temperature is higher. As a result, the glow plugs are brought to a higher temperature when the engine is cold than when the ambient temperature is higher. The thermal switch allows the glow plugs to be heated more rapidly, since the thermal switch limits the maximum temperature which the glow plug can reach during the initial heating. The temperature of the glow plugs is then held substantially at a constant level by the cycling of the thermal relay switch. A thermal timing switch, also subject to the same ambient temperature conditions, controls the length of time the glow plugs remain on after the engine is started. Because the thermal timer is subject to ambient temperature conditions, the time the glow plugs are on is increased as the ambient temperature decreases. In addition, a thermal responsive circuit breaker switch mounted with the other two switches and subject to the same ambient temperature conditions operates to shut off the primary controller if the circuit draws excessive current, or if the primary controller does not function within a pre-determined time interval.

These and other features and advantages of the present invention are achieved by providing a glow plug controller device for controlling the temperature of glow plugs in a diesel engine by cycling current from a battery to the glow plugs through a relay-operated switch. The relay is controlled by a primary thermal switch which includes a bimetal element heated by a resistance heater, the bimetal element operating a switch which turns the relay on and off as the bimetal element is heated and cooled. The heater is controlled by the relay so that the heater is cycled in unison with the glow plugs. The heating and cooling rates of the bimetal element and the glow plugs are made proportional. A thermal timer element mounted with the primary controller interrupts current flow to the first heater and the glow plugs after a predetermined time interval. The timer includes a bimetal element subject to the same ambient temperature conditions as the primary switch. The bimetal element of the timer is heater by a resistance heater energized from the alternator so that the timer begins to function only after the engine is started. A thermal circuit breaker has a heating element connected in series with the coil of the relay. If the primary switch fails to cycle the relay, the breaker interrupts the current through the relay to prevent overheating of the glow plugs.

DESCRIPTION OF THE DRAWINGS

For a more complete understanding of the invention reference should be made to the accompanying drawings, wherein.

DETAILED DESCRIPTION

Figure 1:
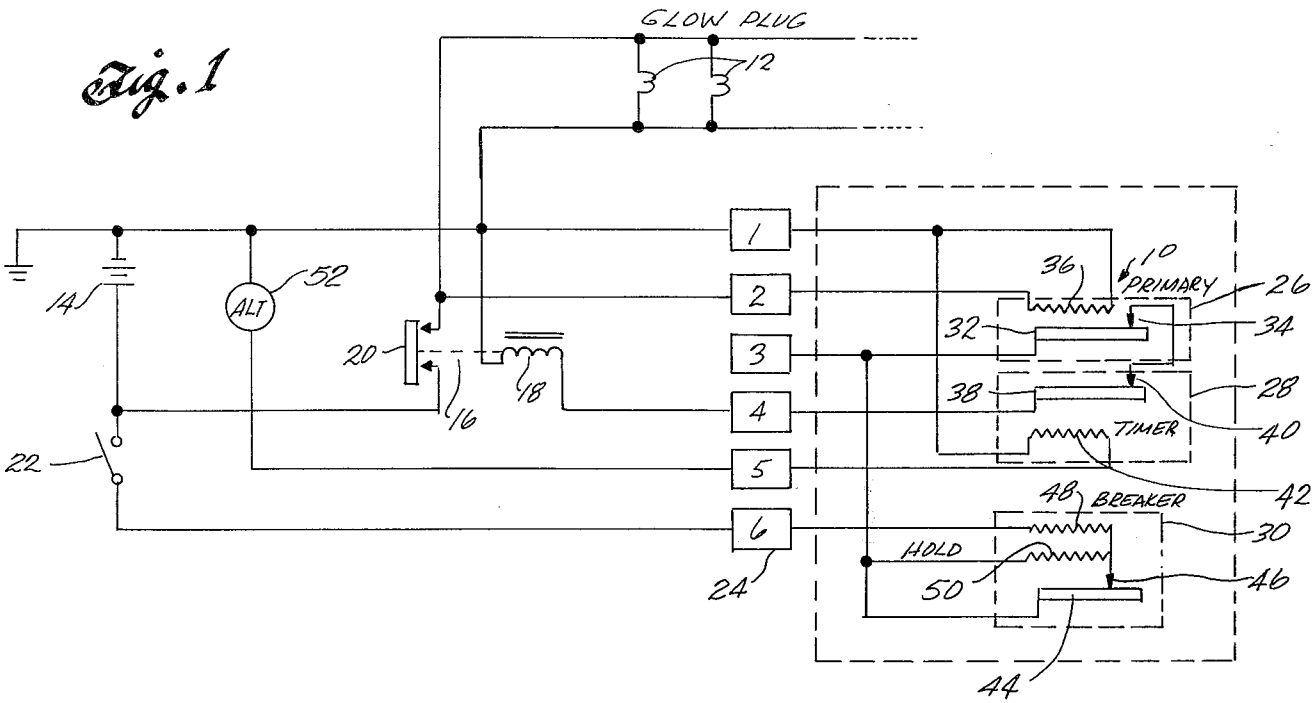
FIG. 1 is a schematic wiring diagram of the glow plug control circuit of the present invention.
Figure 1A:
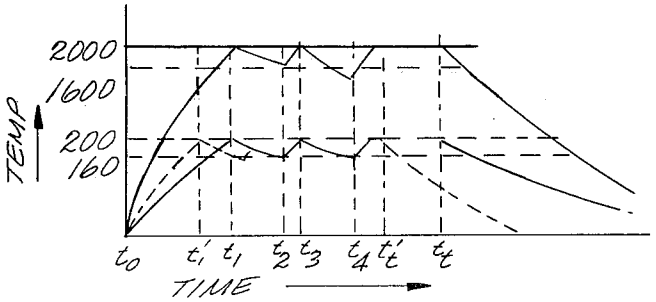
Figure 2:
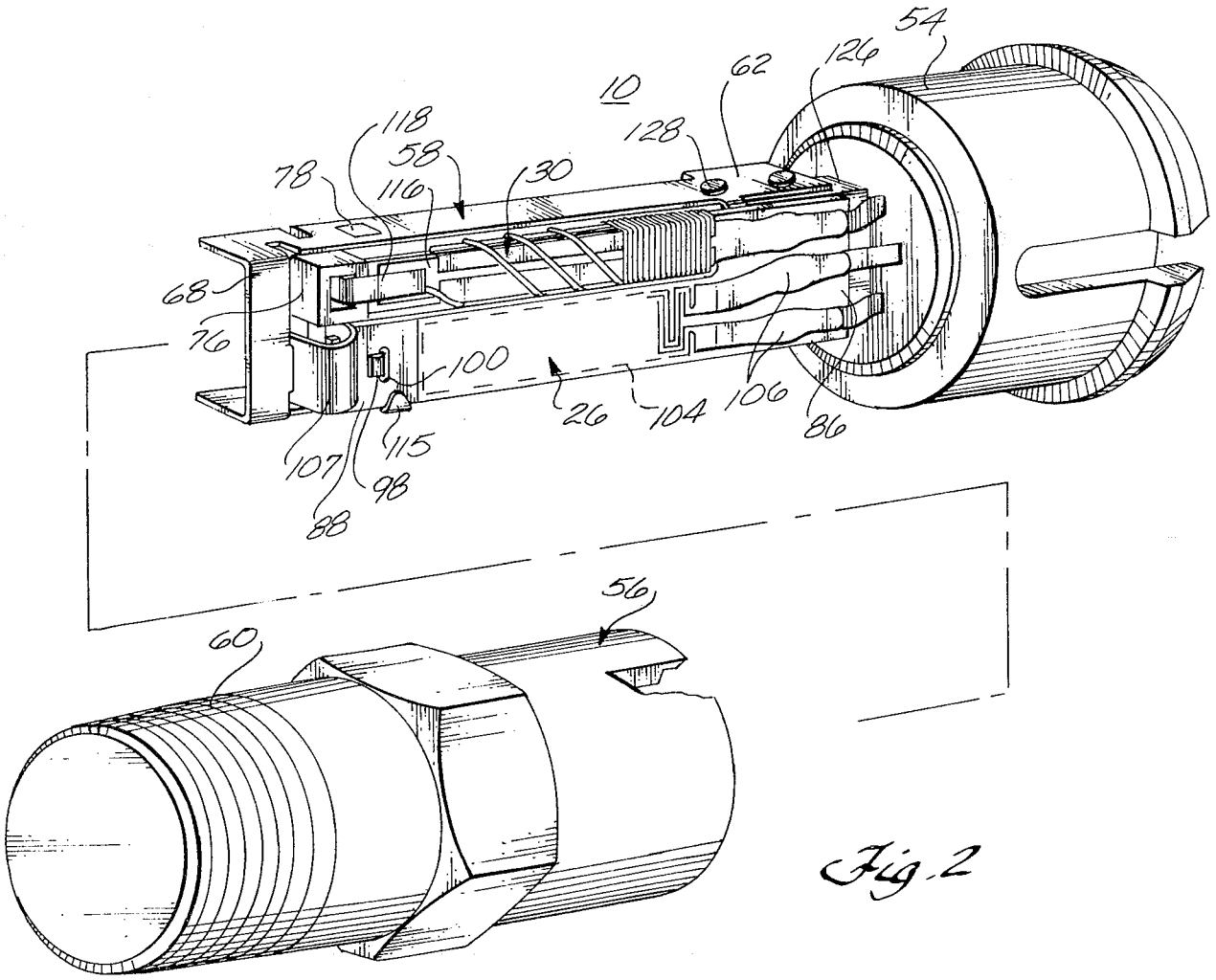
FIG. 2 is a perspective view of the control assembly with the housing removed.

Referring to the circuit diagram of FIG. 1, the numeral 10 indicates generally the glow plug controller unit of the present invention which controls a group of glow plugs, two of which are indicated at 12, from a battery 14 through a relay 16. The relay includes a solenoid coil 18 and a normally open switch 20. When the coil 18 is energized, the switch 20 is closed, completing a circuit between the battery 14 and the glow plugs 12. The relay coil 18 is operated from the battery 14 by the controller unit 10 when an ignition switch 22 is closed. The controller unit 10 is connected electrically to the rest of the circuit through a terminal 24 preferably having six contacts.

The controller unit 10 includes three thermally-operated switch elements, the primary switch element 26, the thermal timer switch element 28, and the circuit breaker switch element 30. The design of the controller unit 10 with each of these three switch assemblies 26, 28 and 30 is described below in detail. The primary switch element 26 includes a bimetal element 32 which operates normally closed switch contacts 34. A resistance heater element 36 heats the bimetal element 32 to open the normally closed switch contacts 34. Similarly the timer switch element 28 includes a bimetal switch member 38 which operates normally closed contacts 40. The bimetal member 38 is controlled by a heater 42 which heats the bimetal member 38 to open the normally closed contacts 40. The circuit breaker switching element 30 includes a bimetal member 44 which operates normally closed contacts 46. A resistance heater element 48 applies heat to the bimetal member 44 to open normally closed contacts 46. An auxiliary resistance heating element 50 in parallel with the switch contacts 46 operates to hold the switch contacts in the open position once the current path through the switch is interrupted.

The normally closed contacts 34, 40, and 46 are connected in series with the relay coil 18 and the circuit breaker heater 48 across the battery 14 when the switch 22 is closed. Thus when the ignition switch 22 is closed, the relay 16 is operated, closing the switch 20 and providing current to the glow plugs. Closing of the switch 20 also causes the heater 36 of the primary switch element 26 to be connected across the battery. This causes both the glow plugs 12 and the bimetal member 32 heated by the heater 36 to begin heating. A plot of temperature as a function of time is shown in FIG. 1-A, with $t_0$ representing the time the switch 22 is closed. It will be seen that the temperature of the glow plugs and the temperature of the heater rise exponentially, the temperature of the glow plugs increasing more rapidly than that of the temperature of the bimetal member 32. At a time $t_1$, the heat applied to the bimetal member 32 of the primary switch element 26 is sufficient to cause the normally closed contacts 34 to open, thus interrupting the flow of current through the relay coil 18, opening the switch 20 and interrupting current flow to the glow plugs 12 and the heater 36. Thus, as shown in FIG. 1-A, the temperature of the glow plugs and the bimetal member 32 fall together exponentially. At time $t_2$ the temperature of the bimetal member 32 of the primary switch 26 has cooled sufficiently so that the contacts 34 are again closed, re-energizing the relay 16 and causing the glow plugs 12 and bimetal member 32 to again rise in temperature until, at time $t_3$, the contacts 34 again open. The cycles of alternate heating and cooling continue in this manner until the time out period $t_t$ at which the thermal timer switch element 28 operates to open the normally closed contacts 40, releasing the relay 16 and turning off the glow plugs 12.

The thermal timer element 28 is operated by connecting the heater 42 across an alternator 52 driven by the diesel engine (not shown) in which the glow plugs are mounted. Thus the heater 42 of the thermal timer element 28 begins to function only when the diesel engine begins to drive the alternator 52 to produce a voltage which is applied across the heater 42. The thermal timer element 28 has a built-in thermal delay which causes the contacts 40 to be opened by the bimetal member 38 after when the bimetal reaches a predetermined temperatures. The time interval after power is applied to the heater 42 before the switch contacts 40 are opened depends on the initial temperature of the bimetal member 38.

The circuit breaker switch element 30 responds to the flow of current through the relay coil 18. If, due to some malfunction, the relay coil remains energized during the initial period for an inordinate length of time rather than cutting off at time $t_1$, the bimetal member 44 of the breaker element 30 will be heated by the heater 48 sufficiently to cause the contacts 46 to open. This prevents the glow plugs 12 from becoming damaged by overheating. Also, if the level of current through the relay coil is too high for any reason, the breaker will also interrupt the current through the relay. After the contacts 46 open, a small current through the higher resistance auxiliary heater 50 holds the contacts open until the ignition switch 22 is turned off. A suitable warning light (not shown) may be provided which is activated when the contacts 46 are open to indicate that the breaker has responded to a malfunction.

Figure 3:
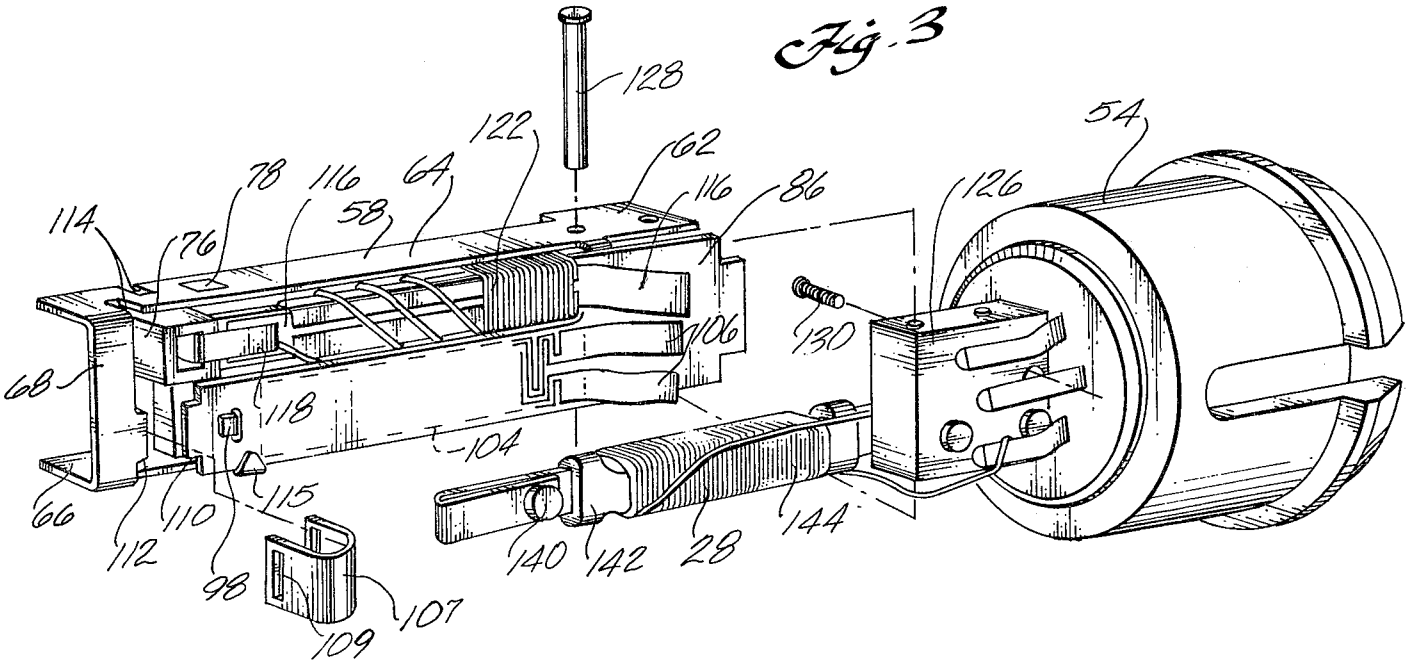
FIG. 3 is an exposed view showing the assembly frame removed from the base receptacle.
Figure 5:
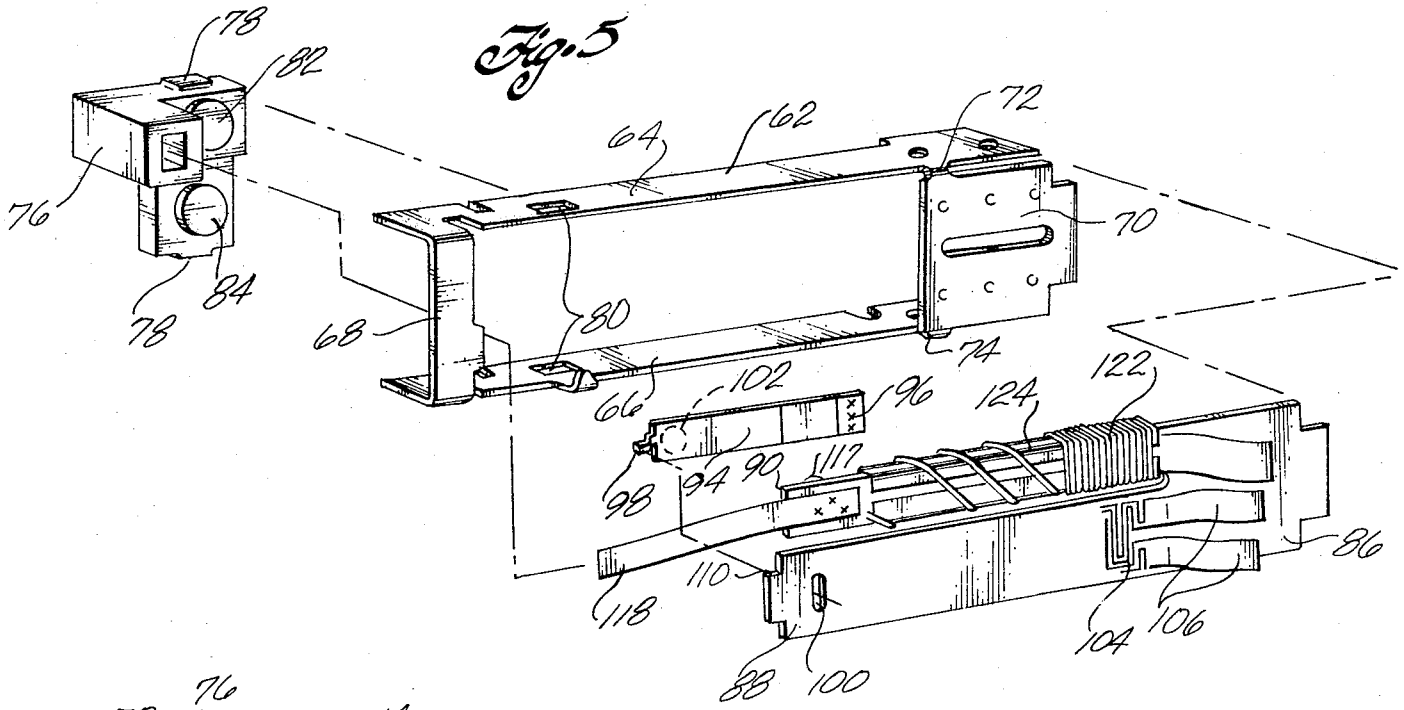
FIG. 5 is an exploded view of the main bimetal assembly.
Figure 8:
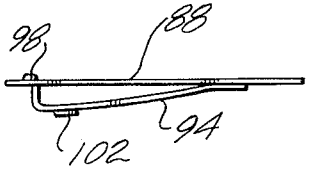
FIG. 8 is a partial view of the contact of the primary switch element.
Figure 4:
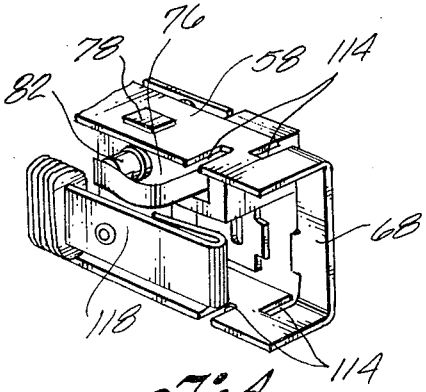
FIG. 4 is a partial view of the outer end of the bimetal frame assembly.

The construction of the controller unit 10 is shown in detail in FIGS. 2–6. The controller unit 10 includes a base receptacle 54 of insulating material which is adapted to receive a standard cable connector. A housing 56 fits over the base receptacle 54 to form a sealed chamber in which the switching element assembly 58 is mounted. The outer end of the housing 56 is provided with a tapered external thread 60 by which it can be mounted in the engine block. The housing 56 is made of metal to provide good thermal conductivity with the engine block. As best seen in FIGS. 3 and 5, the thermal switch assembly 58 includes a substantially channel-shaped metal frame 62 having a pair of parallel side members 64 and 66 joined at the outer end by a bridging member 68 and at the other end by a support member 70 connected to the side members 64 and 66 by integral connecting tabs 72 and 74. A molded plastic contact support block 76 fits between the side members 64 and 66 and is held in place by projecting lugs 78 which engage openings 80 in the side members of the frame. The block 76 supports two electrical contacts 82 and 84. Both contacts extend through the block, the contact 82 being threaded into the block 76 so that it can be adjusted in and out relative to the block.

A bifurcated bimetal blade 86 provides two switch arms 88 and 90. The blade 86 is welded or otherwise secured to the support plate 70 of the frame 62 so that the two switch arms 88 and 90 are supported in cantilever fashion. The arm 88 is provided with a spring contact leaf 94 which is spotwelded or otherwise secured at one end to the bimetal arm 88, as indicated at 96. The other end of the contact leaf 94 has a projecting lug 98 which engages a slot 100 in the bimetal arm 88. The contact leaf supports an electrical contact 102 which is positioned to engage the contact 84 carried by the block 76. At the ambient temperatures encountered when the engine is not warned up, the bimetal arm 88 moves the contact leaf 94 and contact 102 against the contact 84. The contacts 84 and 102 form the normally closed contacts 34 of the primary switch element 26 of FIG. 1, while the bimetal arm 88 forms the bimetal 32 of the primary switch element 26, shown in FIG. 1.

A heater element in the form of a serpentine-shaped printed circuit conductor 104 terminating at either end in flat output leads 106 is applied to the surface of the arm 88. A very thin layer of electrically insulating material is interposed between the printed circuit heater element 104 and the metallic surface of the bimetal arm 88 to provide electrical isolation between the heater and the bimetal arm while providing good thermal transfer. The printed circuit element 104 forms the heater 36 of the primary switch element 26, shown in FIG. 1.

As the bimetal arm 88 is heated by passing current through the heater 104, the bimetal moves the contact 102 away from the contact 84. A U-shaped spring 107 is interposed between the outer end of the bimetal arm 88 and the cross member 68 of the frame 58. The U-shaped spring is held in place by slots 109 which engage projections 110 and 112 on the end of the arm 88 and cross member 68, respectively. The spring 107 provides an overcenter snap action to the movement of the bimetal arm 88 as it bends back and forth by heating and cooling. A pair of notches 114 in each of the side members 64 and 66 of the frame 62 allows the cross member 68 to be bent slightly with respect to the rest of the frame, providing an adjustment to the temperature at which the snap action takes place and thereby controlling the time period of the On-Off cycle. The contact leaf 94 insures that closed contact pressure is maintained between contacts 102 and 84 until the moment the bimetal arm 88 moves sufficiently to initiate the snap action. Thus the contact force remains high until the snap action is in process. This action greatly extends the contact life of the primary switch element. A stop 115 on the frame 62 limits the movement of the bimetal arm 88 in a direction away from the contact 84.

The bimetal arm 90 forms the bimetal element 44 of the circuit breaker switch element 30 shown in FIG. 1. The heater 48 of the circuit breaker 28 is provided by a thin metal conductive strip 116 applied to the outer surface of the bimetal arm 90, a thin electrically insulative layer being superimposed between the conductive strip 116 and the bimetal surface. A contact 117 is secured adjacent the outer end of the bimetal arm 90 on the opposite side from the heater in position to engage the contact 82 of the contact support assembly. The contacts 82 and 117 form the normally closed contacts 46 of the circuit breaker switch element 30. A conductive strap 118 connects the heater to the back of the contact 82, thus providing a current path through the heater strip 116, normally closed contacts 82 and 117, and through the bimetal arm 90 to the bimetal arm 88. A wire wound coil 122 is wrapped around an insulating sleeve 124 on the bimetal arm 90. The wire coil 122 operates as the holding heater 50, shown in the wiring diagram of FIG. 1. One end of the heater coil 122 is connected to the conductor strap 118, while the other end is connected to the bimetal arm 90.

As shown in FIG. 3, the entire bimetal switch and frame assembly is supported on the base receptacle 54. To this end the base receptacle has an integrally molded support 126 which fits between the side members 64 and 66 of the frame 62. Rivets 128 are inserted through aligned holes extending through the frame and the support 126 to secure the frame 62 securely to the base receptacle 54. The heater leads 106, 108 in the end of the heater strip 116 are then spot-welded or otherwise secured to electrical terminals extending from the base receptacle 54. An adjustment screw 130 is threaded through the support 126 and engages the back of the support plate 70 of the frame 62. This screw provides an adjustment for controlling the length of the initial On time ($t_0$ to $t_1$ in FIG. 1-A).

Figure 6:
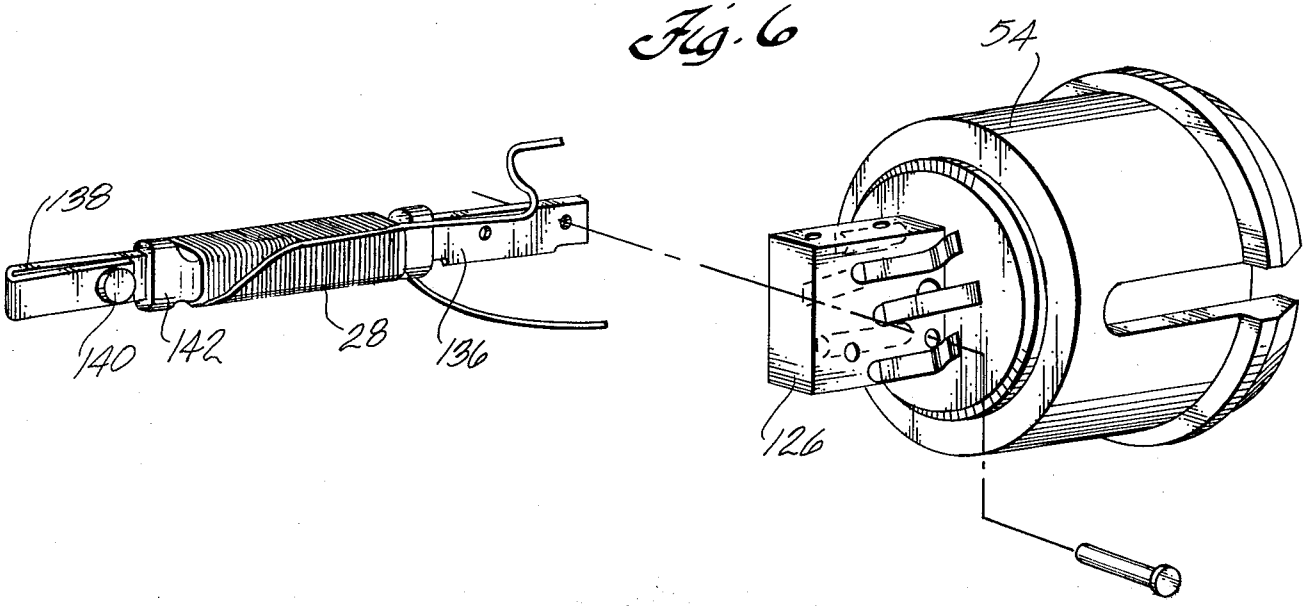
FIG. 6 is an exploded view showing the manner in which the after glow timer is assembled and mounted on the base receptacle.

The afterglow timer switch element 28 is mounted as a separate assembly on the support 126 of the base receptacle 54, as best seen in FIGS. 3 and 6. The timer element 28 includes a bimetal member 136 which is riveted or otherwise secured to the support 126 adjacent one end. The other end is bent in a U-shape portion 138 and has a contact 140 secured to the folded end. The contact 140 normally engages the contact 84 mounted in the contact support block 76. Thus the fixed contact 84 provides a direct electrical connection between the moving contact 102 of the primary switch element and the moving contact 140 of the timer switch element. A sleeve 142 is positioned on the bimetal member 136 to increase the thermal mass of the timer element. A wire-wound resistance heater 144 is wrapped around the sleeve 142 and the ends of the heater are connected to appropriate electrical terminals of the base receptacle 54.

Figure 7:
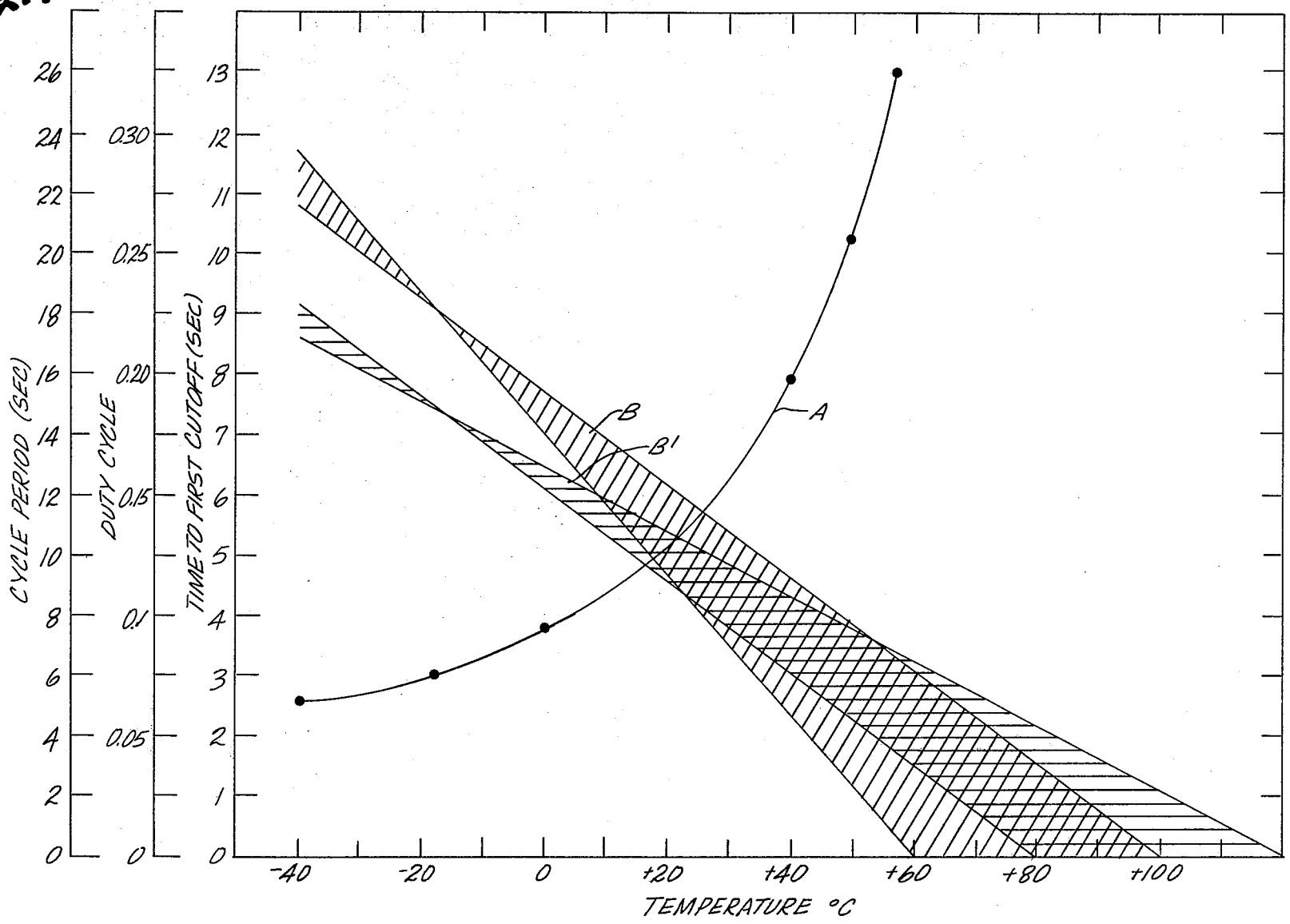
FIG. 7 is a performance diagram used in explaining the operation of the present invention.

The effect of ambient temperature changes on the operation of the primary thermal switch element 26 is shown in FIG. 7. Curve A shows the change in the cycle period as a function of ambient temperature. It will be seen that the cycle period becomes substantially longer as the ambient temperature approaches the operating temperature of the engine block. Curves B and B′ show a range of curves plotting the duty cycle (percentage of each period that the glow tubes are turned on) as a function of ambient temperature. It will be seen that as the ambient temperature approaches the operating temperature of the engine the duty cycle decreases towards zero. Finally, curves C and C′ show the range of curves plotting the time for the glow plugs to first cut-off as a function of ambient temperature. Again it will be seen that as the ambient temperature approaches the operating temperature of the engine, the initial heating time of the glow tubes is reduced to zero. The desired characteristics are achieved by controlling the thermal mass and heat dissipation of the bimetal element, the resistance of the heater, the areas of the bimetal element that are heated, the temperature differential for the snap-action, and the screw adjustment for controlling the initial time for the switch to open. The time period is controlled by bending the position of the bridging member 68 to change the snap-action of the spring 107. The duty cycle is automatically achieved by the choice of bimetal heat capacity and thermal dissipation properties. Because both the thermal relay and the glow plugs operate in unison and are subject to the same voltage changes of the source, the temperature of the thermal switching element and the glow plugs are proportional, as shown by FIG. 1-A.

While the described control device is particularly well suited to thermal control of glow plugs which operate in rapidly changing ambient temperature conditions due to engine heating, the control device may be used to control other types of electrical loads, such as electric window defrosters, and the like. The control device, unlike conventional thermostatic controls, does not directly sense the temperature change of the load, but operates as a thermal analog which heats and cools in proportion to the heating and cooling of the load, and yet responds to changes in the ambient conditions of the load.

What is claimed is:

1. A thermal control device for controlling the heating of diesel engine glow plugs or the like, comprising: a base, a first bimetal element supported at one end on the base, first electrical heater means adjacent the surface of the first bimetal element for heating the bimetal element, a second bimetal element supported at one end on the base, second electrical heater means adjacent the surface of the second bimetal element, switch means operated by each of the bimetal elements, the switch means having normally closed contacts connected in series, and means responsive to a current through the series connected normally closed contacts for turning on the glow plugs, whereby either bimetal element when heated interrupts current to the glow plugs, the thermal responsive time of the first bimetal element, first heater means, and switch means being substantially faster than the response time of the second bimetal element, second heater means, and switch means.

2. Apparatus of claim 1 wherein the series connected current path through the switch means includes both bimetal elements, whereby both bimetals are directly heated electrically by current flow through the bimetal elements.

3. Apparatus of claim 2 wherein the second bimetal element includes a reverse bend between the surface adjacent the second heater means and the switch contacts, whereby heating of the bimetal by current flow through the switch means moves the contact in the opposite direction from heating by the second heating means.

4. Apparatus of claim 1 further including a third bimetal metal element supported at one end on the base, third electrical heater means associated with the third bimetal, and switch means having normally closed contacts that are opened by heating of the third bimetal element, said normally closed contacts being series connected with the switch means associated with the first and second bimetal elements and the third heater means.

5. Apparatus of claim 4 further including a heat conductive support having a chamber, said base being secured to the support with the bimetal elements extending into and enclosed by said chamber, and mounting means for securing the support in heat conductive relationship to the engine.

6. Apparatus of claim 4 wherein the first and third bimetal elements comprise a single bifurcated piece of bimetal.

7. Apparatus of claim 1 wherein the first switch means includes a fixed contact supported from the base, a moving contact, a spring member connecting the moving contact to the first bimetal element, the spring means urging the moving contact away from the bimetal element toward the fixed contact, and over-center spring means engaging the first bimetal element for producing a snapaction motion of the bimetal element.

* * * * *